United States Patent [19]

Edwards

[11] 4,203,099

[45] May 13, 1980

[54] SENSOR FOR SOFT DRINK DISPENSER

[75] Inventor: Raymond A. Edwards, New York, N.Y.

[73] Assignee: Elser Farms Corporation, West Chester, Pa.

[21] Appl. No.: 917,509

[22] Filed: Jun. 21, 1978

[51] Int. Cl.[2] ..... G08B 19/00

[52] U.S. Cl. ..... 340/619; 340/618

[58] Field of Search ..... 340/619; 222/66

[56] References Cited

U.S. PATENT DOCUMENTS

| | | | |
|---|---|---|---|
| 3,242,794 | 3/1966 | Crane | 340/619 |
| 3,994,175 | 11/1976 | Yamaguchi | 340/619 |

*Primary Examiner*—Harold I. Pitts
*Attorney, Agent, or Firm*—Paul & Paul

[57] ABSTRACT

A photoelectric sensor circuit may be provided for a soft drink dispenser for indicating when a supply tank within the dispenser has run dry of fluid. Said circuit employs preferably an orthogonal reflection photosensor for sighting through the supply line for triggering an electronic relay which operates audio and visual alarms and for triggering additional control signals to the dispensing machine control box for altering the operation of the dispensing machine when it has been determined that the supply line is empty.

8 Claims, 4 Drawing Figures

SENSOR FOR SOFT DRINK DISPENSER

BACKGROUND OF THE INVENTION

This invention relates to fluid gages and meters and in particular sensors for indicating when dispensing machines such as soft drink dispensers have run out of one or more of the syrup, carbonated water, or other ingredients used in the machine.

In the past soft drink and other dispensers have used a number of sensing mechanisms for determining when syrup and carbonated water reservoirs have been emptied. These sensors have included float type tank gages having a flotation device connected to a stationary pivot point and initiating an electrical signal when the float has fallen to the bottom of the tank. This type of fluid supply sensor, however, has proven unsatisfactory for soft drink dispensers and vending machines. These dispensers handle a variety of syrups and other sugar products, which tend to build up coatings on the walls of the tanks and on the float sensor over a period of time. Such coatings alter the operational characteristics of the float level indicator which becomes more sluggish with time. Very often electrical contacts associated therewith also become coated rendering the sensor inoperative. Under such conditions the sensor will either indicate that the machine is out of syrup or will indicate a constantly full condition even after an emptying has occurred.

Another type of sensor used to indicate the presence or absence of fluid from a storage tank is an electrically conductive electrode pair. This type of sensor comprises a pair of electrodes which are inserted into the storage tank from the top, protruding to a point in close proximity but not touching the bottom of the tank. A very mild electric current is passed between the two electrodes and will continue to be conducted until the fluid within the tank has been completely emptied. When this fluid has been completely emptied the electrical current activities between the two electrodes are eliminated, indicating an empty tank. This indicator also may take a second form having pair of small rectangular or circular electrodes, mounted by means of an insulator to opposing walls of the tank near the bottom of the tank. As with the rod type electrodes described above, these electrodes pass a very mild current between themselves when a fluid level permits condition.

Level indicators as these tend to build up coatings of syrup or other materials on their surfaces. As this coating builds up, the electrical activity between the electrodes diminishes.

These prior art syrup level sensors have to be cleaned periodically in order to function properly, requiring regular servicing of the machine and increasing the operating cost per machine. It is desirable therefore to develop a tank sensor which does not require cleaning and regular servicing.

An object of this invention is to provide a "tank-empty" sensor which determines when a tank has been emptied of syrup or other fluid normally held therewithin.

A second object of this invention is to provide such a sensor which need not be inserted into the syrup tank and which need not come in direct contact with the syrup held therewithin.

A further object of this invention is to provide such a sensor including circuitry for initiating an empty tank alarm and for activating controls to apparatus associated with the tank, for altering the operation of that apparatus as a function of the empty tank.

SUMMARY OF THE INVENTION

The objects of this invention are realized in an empty tank sensor for a soft drink dispensing machine wherein photoelectric sensing components are connected to a discharge tube from a syrup tank for photoelectrically sensing the presence of a fluid or syrup in that discharge tube for determining the presence of fluid therein as an indication of the presence of fluid or syrup in the tank.

A transparent discharge tube may be used from the vending tank. A light source may be positioned to provide rays of light through the walls of this circular discharge tube, such rays of light being directed to travel in a single direction directly into the tube. Positioned orthogonally (90°) about the tube from the source of light may be a photo sensor which photo sensor may receive reflected light off of the inside curved surfaces of the tube when the tube is empty and no reflected light when the tube is filled. A second photosensor may be utilized to determine if the light source has burned out.

The photosensors may be connected as part of an electronic circuit which may be used to drive control relays for altering the function of the dispensing machine in response to an empty tank indication.

Audio and visual alarms may be employed to signify that an empty tank condition has been arrived at.

DESCRIPTION OF THE DRAWINGS

The advantages, features and operations of this invention will best be understood from a reading of the following detailed description of the invention in conjunction with the attached drawings in which like numerals refer to like elements and in which.

DETAILED DESCRIPTION OF THE INVENTION

An empty tank sensor may be connected to the transparent discharge tank of a soft drink or syrup tank for a soft drink dispensing machine. This sensor is positioned in close proximity to the exit port of the tank and normally between the tank and a valve or pump associated therewith directing the flow of the fluid or syrup out of the tank.

Figure 1:
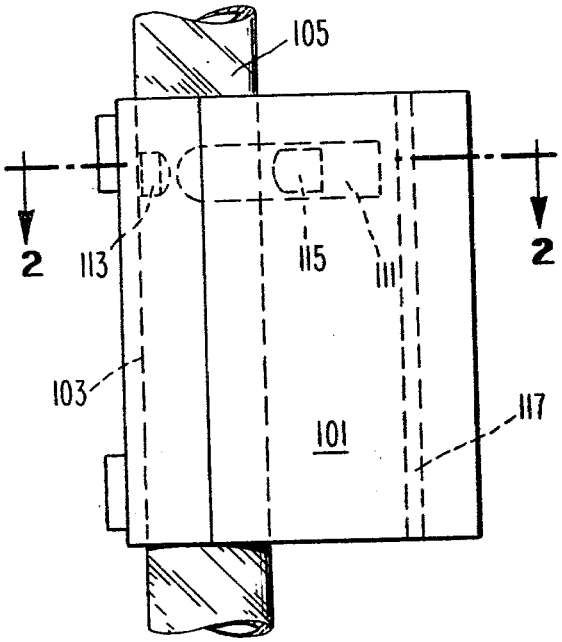
FIG. 1 shows a side elevation of the fluid sensing apparatus coupled to the discharged tube from a fluid tank.

Such a sensor FIG. 1 includes a housing 101 which may be essentially rectangular although its outer shape is of no consequence to the thrust of this invention. The housing 101 may be made up of a number of machined portions which are screwed or othewise attached to one another being of opaque material possessing relatively low reflective properties, as an example, black nylon. A circular hole 103 has been established through the housing 101 for receiving the transparent discharge tube 105. With this in mind, respective portions of the housing 101 may be mated at the hole 103 location of the housing which will enable the housing 101 to be assembled about the transparent discharge tube 105. Positioned within the housing 101 in a single plane which transects the hole 103 are a first and second cavities 107, 109. The cavities 107, 109 are positioned to open onto the cylindrical hole 103 in close proximity to one another with a circular displacement of 90° about the hole 103 of one to the other.

Positioned within the first cavity 107 is a light source 111 and an integrity photosensor 113. Positioned within the second cavity 109 is a syrup sensing, second, photosensor 115. The light 111 and first and second photosensors 113, 115 are each connected as part of an electrical circuit, the remaining components of which are mounted upon a printed circuit board 117 positioned within the housing 101 but removed from the cylindrical hole 103.

Figure 2:
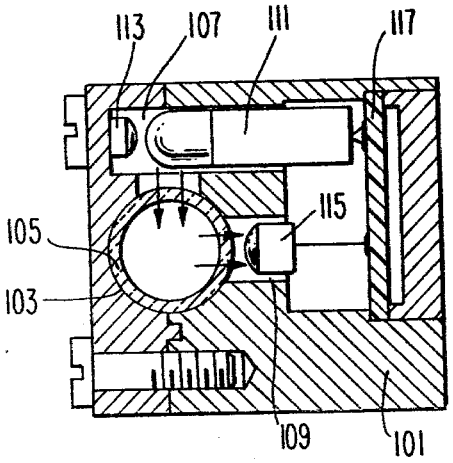
FIG. 2 is a sectional view through the sensor apparatus of FIG. 1.

FIG. 2 shows a crossectional view through the housing 101 in the plane of the first and second cavities 107, 109 showing the light 111 and photosensors 113, 115 as well as the transparent discharge tube 105 in axial crossection. Herein it can be seen that the housing 101 includes first and second portions joined together about a longitudinal crossection through the transparent discharge tube 105, the light source 111 being inserted into the first cavity 107 which is established by compound drill hole 107 through the housing 101. The first portion of this hole 107 traverses tangent to the circular surface of the discharge tube 105, a second portion trasverses radially into the surface of the transparent discharge tube 105.

The second cavity 109 is established by a simple drill hole extending axially into the curved surface of the transparent discharge tube 105 at a rotational angle of 90° about the tube 105 from the first drill hole 107.

Figure 3A:
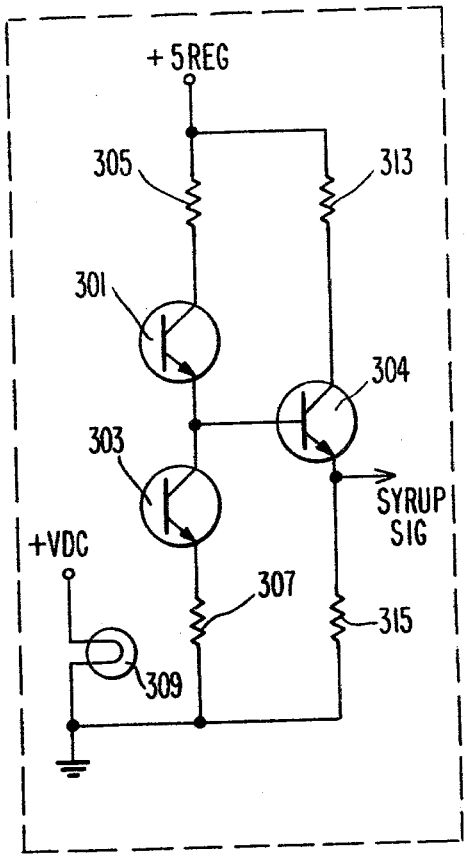
FIGS. 3 and 3A are a circuit diagram of the electronic circuitry which the photosensor and light source are a part.
Figure 3:
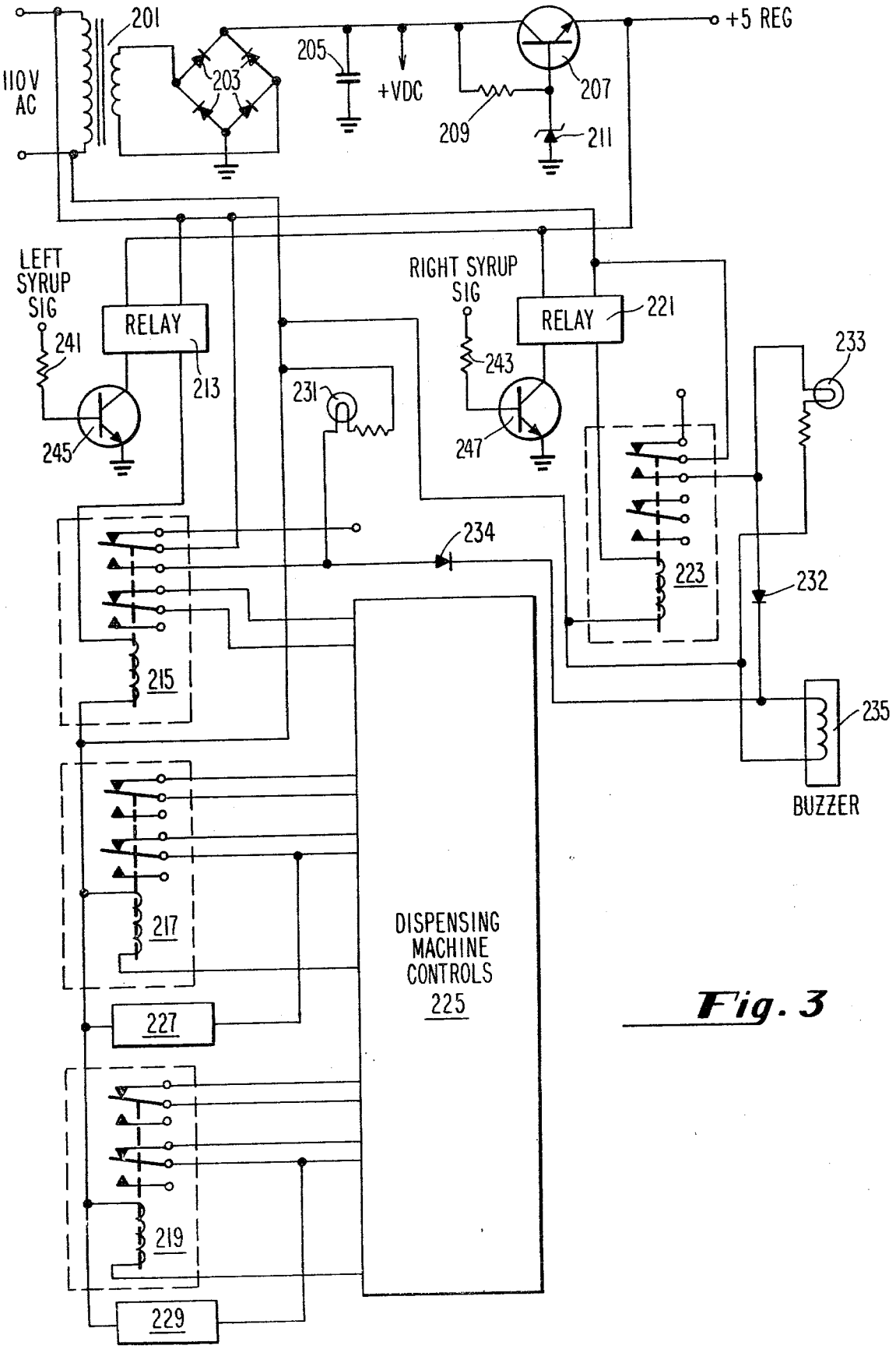

FIG. 3 shows the circuit comprising the electrical portions of the invention. As part of the electrical circuitry of FIG. 3 left and right syrup sensing components are shown in FIG. 3A. As most soft drink dispensing machines mix two or more syrups or fluids, the sensing portion of the circuit shown in FIG. 3A represents identical circuits for either right or left syrup sense components, or for as many sense components as there are syrups or fluids to be monitored.

Circuit sensing control circuitry, FIG. 3, is powered by a +5 volt regulated power supply which forms part of the circuit and which includes a 10 to 1 AC step down transformer 201 and a full wave diode rectifier connected to the secondary of said transformer 201. This rectifier comprises a bridge of 1 N 4003 type diodes 203. The cathode to anode junction points of this diode 203 bridge are connected to either side of the secondary of the transformer 201 while the anode to anode junction point is grounded. The cathode to cathode junction point of this diode 203 bridge is connected to ground through a 0.1 microfarad capacitor 205 having a Sprague part number 500 D-109G-016-FR7. The collector of a power transistor 207, Motorola type MJE520, is connected to the high side of the capacitor 205. This transistor 207 has its collector and base terminals connected through a 12 ohm resistor 209. The emitter of this transistor 207 forms the +5 regulated voltage out to the rest of the circuitry. A 1N752 type Zener diode 211 is connected between the base of the transistor 207 and ground. This Zener diode 211 operates to clamp the regulated voltage (+5 volts).

A Sigma Manufacturing Corporation type 22615A AC relay 213 is connected in common with the primary of the transformer 201 across the 110 volt AC power source for driving a Schrack type RA404-115 AC relay 215 and an additional power of Schrack AC relays 217 and 219, respectively, these latter relays 217, 219 being of type RM202610. A second Sigma 22615A relay 221 is similarly connected to drive a second Schrack RA404-115 relay 223. The relays 213 and 221 are each connected to the regulated +5 volts from the emitter of the transistor 207.

The outputs of relays 217 and 219 are each connected to the vending machine controls 225 which operate the soft drink dispensing machine. A pair of low pass filters 227 and 229 are connected, one each respectively, across the relays 217 and 219 to suppress transient signals created by the operation of these relays.

Output terminals, similar from the relays 215 and 223, are each connected to respective lamps 231 and 233 and to an EC Manufacturing Company type 120E29T buzzer 235. The latter connections to said buzzer 235 being each through respective 1N4003 type diodes 234, 232. The relays 215, 217, 219, 223 discussed above are all 110 volt AC relays. Similarly, the lamps 231 and 233 as well as the buzzer 235 are 110 volt AC operated.

The relay 213 and the relay 215 with their interconnected lamp 231 and diode 234 forms a left syrup signal circuit which is also connected to the buzzer 235. The relay 221 and the relay 223 with its interconnected lamp 233 and diode 232 forms the right syrup signal circuit, this circuit also being connected to the buzzer 235. When the sensor circuit components of FIG. 3A, which are provided in duplicate, one for the left-side syrup and one for the right-side syrup, senses the absence of syrup, the lamps 231, 233 and the buzzer 235 provide a visual and audio alarm indicating that the dispensing machine is out of at least one of the components dispensed, that particular syrup component being identified.

Signals received from sensor circuits FIG. 3A (which will be discussed in greater detail below) are connected respectively through left and right 680 ohm resistor 241 and 243, respectively, to the base of a left and right switching transistor 245, 247, respectively, the emitter of each of the transistors 245, 247 being connected to ground while the collector of the transistor 245 is connected to the relay 213 and the collector of the transistor 247 is connected to the relay 221.

Left and right sense circuits components, FIG. 3A, each include a pair of FPT 100 Motorola Photo Transistors 301 and 303 connected emitter to collector respectively. These transistors 301 and 303 have their base terminals open while the collector of photo transistor 301 is connected through a 1 K ohm resistor 305 to the +5 regulated voltage supply. The emitter of the second photo transistor 303 is connected through a 22 K ohm resistance 307 to ground. A General Electric type 7349 lamp 309 is connected between the +DC voltage on capacitor 205 and ground.

A switching transistor 304 is connected with its base terminal tied to the emitter of the first photo transistor 301. This transistor 304 is a Motorola type 2N440 and has its collector terminal connected through a 510 ohm resistance 313 to the +5 volts regulated voltage supply, and its emitter terminal connected through a 390 ohm resistance 315 to ground. Transistor 304 is connected on its emitter to drive the transistor switches 245 or 247 in the left or right syrup signals portions as the case may be, of the circuit through the 680 ohm resistances 241, 243, respectively.

Any syrup sensing circuit for controlling the operation of the vending machine controls 225 would preferably have a plurality of syrup sensing circuits as described in connection with FIG. 3A above. The circuitry of FIG. 3A is duplicated for each syrup tank discharge line sensed, one such circuit being connected to drive a separate relay and alarm circuit of the type described in connection with FIG. 3.

The preferred embodiment described herein has but two syrup lines and two sensing and alarm lamp circuits. Nothing precludes proliferating this plurality to cover as many syrup lines as may be needed.

When syrup or another fluid to be sensed is resident in a tank discharge tube 105, light eminating from the lamp 309 is not reflected off the back wall of the tube 105 and photo sensor transistor 303 is not activated. However, when the tube 105 is empty, light is reflected off the curve back surface of the empty tube sufficient to activate photo transistor 303. With this condition, if integrity burn-out photo transistor 301 is also activated signifying that the lamp 309 is in fact operational, the switch transistor 304 is activated driving its respective switch transistor 245 or 247, as the case may be, to initiate a chain of events caused by the switching of the relays 213, 215, 217, 219 or the relays 221, 223, 217 and 219, as the case may be. Warning lamp 231 or warning lamp 233 will also be lit and the buzzer 235 will be activated. An operator of the dispensing machine or a maintenance man responsible for the machine may quickly diagnose which supply tank is empty.

The present invention provides a mechanical structure and electrical circuit for monitoring the presence or absence of syrup or other fluids held within the tanks of a dispensing machine as a function of the presence or absence of fluids in the discharge tube from the respective tanks. This invention also provides a visual and audio signal as indicative of an empty discharge tube. The monitoring circuit does not have to come in direct contact with the syrup or fluid being monitored. Any possibility of a build-up of coating on the monitoring apparatus is therefore completely eliminated.

The photo sensing circuit of this invention will operate with transparent syrups and fluids, translucent syrups and fluids or opaque syrups and fluids as long as the transparent properties of the tube 105 are not degraded to the point where the reflected light intended to be received by the sensing photo transistor 303 is degraded to the point where photo transistor 303 is not activated properly.

Since many changes could be made in the above-described apparatus, and many different embodiments of this invention could be made without departing from the scope thereof, it is intended that all matter contained in the above description and shown in the accompanying drawings shall be interpreted as illustrative and shall not be taken in the limiting sense.

What is claimed:

1. A sensor apparatus for indicating when a fluid holding tank within a soft drink dispensing machine and the like has been emptied, said tank including a light passing fluid discharge line, at least a portion of the inside wall thereof being a concaved surface, comprising:

photo monitoring means for detecting the presence of fluid in said discharge line;

means, responsive to said photo monitoring means, for providing a signal indicative of the absence of fluid in said discharge line and for initiating a departure of normal dispensing machine opeation as a function of said fluid absence; and photo means for checking the integrity of said photo monitoring means, being optically coupled thereto.

2. The apparatus of claim 1 wherein said photo integrity checking means includes first light sensing means for independently photo sensing the operating state of said photo monitoring means.

3. The apparatus of claim 3 wherein said photo monitoring means includes:

means for supplying rays of light passing through said discharge line for impinging upon said concave inner wall thereof said light supplying means being disposed in close proximity to an outer surface of said line; and means for sensing rays of light reflected off of said concave inner wall, said light sensing means being positioned in close proximity to an outer surface of said line, in the plane of said light supplying means and disposed about 90° of rotation from said light supplying means.

4. The apparatus of claim 3 wherein said signal providing and departure initiating means includes:

circuit means associated with said light sensing means for providing an electrical activation signal as a function of non-reception of light by said light sensing means.

5. A sensor apparatus for indicating when a fluid holding tank within a soft drink dispensing machine and the like has been emptied, said tank including a light passing fluid discharge line, at least a portion of the inside wall thereof being a concaved surface, comprising:

photo monitoring means for detecting the presence of fluid in said discharge line, having means for supplying rays of light passing through said discharge line for impinging upon said concave inner wall thereof said light supplying means being disposed in close proximity to an outer surface of said line, and means for sensing rays of light reflected off of said concave inner wall, said light sensing means being positioned in close proximity to an outer surface of said line, in the plane of said light supplying means and disposed about 90° of rotation from said light supplying means;

means, responsive to said reflected light sensing means for providing a signal indicative of the absence of fluid in said discharge line and for initiating a departure of normal dispensing machine operation as a function of said fluid absence, having circuit means associated with said reflected light sensing means for providing an electrical activation signal as a function of non-reception of light by said reflected light sensing means; and integrity checking means including light sensing means for sensing rays of light eminating directly from said light supplying means, said direct light sensing means being directly adjacent to said light supplying means and being connected to said circuit means, and for inhibiting said electrical activation signal as a function of the non-operativeness of said light supplying means.

6. The apparatus of claim 5 wherein said reflected light sensing means includes:

a first photo transistor connected collector and emitter between a reference voltage and ground respectively; and a first transistor switch, being connected collector and emitter between a reference voltage and ground, respectively, and being biased on its base for conduction by the collector of said photo transistor.

7. The apparatus of claim 6 wherein said direct light sensing and inhibiting means includes a second photo transistor connected into said collector line of said first photo transistor wherein said second photo transistor collector is connected to said reference voltage and emitter is connected to said first photo transistor collector.

8. The apparatus of claim 7 wherein said circuit means includes:

power switch means for providing an activation signal, said switch means being triggered by a connection to said first transistor switch;

relay means for providing a plurality of circuit interconnections, said relay means being operated by said power switch means activation signal;

a visual alarm signal connected to said relay means; and an audio alarm signal connected to said relay means.

* * * * *

UNITED STATES PATENT AND TRADEMARK OFFICE

CERTIFICATE OF CORRECTION

PATENT NO. : 4,203,099

DATED : May 13, 1980

INVENTOR(S) : Raymond A. Edwards

It is certified that error appears in the above—identified patent and that said Letters Patent is hereby corrected as shown below:

Column 2, line 50, "tank", first occurrence, should read -- tube --.

Column 4, line 1, "power" should read -- pair --.

Signed and Sealed this

Fourteenth Day of October 1980

[SEAL]

Attest:

SIDNEY A. DIAMOND

Attesting Officer

Commissioner of Patents and Trademark